US009100750B2

(12) United States Patent
De Haan

(10) Patent No.: US 9,100,750 B2
(45) Date of Patent: Aug. 4, 2015

(54) LOUDSPEAKER

(75) Inventor: Philip Derek Eduard De Haan, Zwaag (NL)

(73) Assignee: Alcons Audio B.V., Zwaag (NL)

( * ) Notice: Subject to any disclaimer, the term of this patent is extended or adjusted under 35 U.S.C. 154(b) by 0 days.

(21) Appl. No.: 13/700,825

(22) PCT Filed: May 27, 2011

(86) PCT No.: PCT/NL2011/050373

§ 371 (c)(1),
(2), (4) Date: Feb. 13, 2013

(87) PCT Pub. No.: WO2011/152718

PCT Pub. Date: Dec. 8, 2011

(65) Prior Publication Data

US 2013/0195305 A1 Aug. 1, 2013

(30) Foreign Application Priority Data

May 31, 2010 (NL) ..... 20040781

(51) Int. Cl.

| | |
|---|---|
| ***H04R 1/22*** | (2006.01) |
| ***H04R 1/28*** | (2006.01) |
| ***H04R 1/34*** | (2006.01) |
| *H04R 1/30* | (2006.01) |

(52) U.S. Cl.

CPC ..... *H04R 1/22* (2013.01); *H04R 1/288* (2013.01); *H04R 1/345* (2013.01); *H04R 1/30* (2013.01)

(58) Field of Classification Search

CPC ..... H04R 1/345; H04R 1/2807; H04R 1/288; H04R 1/22; H04R 1/36

USPC ..... 381/338, 339, 343, 347, 351, 353, 391; 181/181, 189, 175, 198, 199

See application file for complete search history.

(56) References Cited

U.S. PATENT DOCUMENTS

| | | | | |
|---|---|---|---|---|
| 1,884,724 | A * | 10/1932 | Keller | 181/148 |
| 4,012,605 | A * | 3/1977 | Jasinski | 381/347 |
| 4,776,428 | A * | 10/1988 | Belisle | 181/185 |
| 4,933,981 | A | 6/1990 | Lederer | |
| 7,953,238 | B1 * | 5/2011 | Adams | 381/340 |
| 8,111,853 | B2 * | 2/2012 | Isvan | 381/337 |
| 2005/0286735 | A1 * | 12/2005 | Ikeuchi | 381/391 |
| 2007/0160233 | A1 * | 7/2007 | De Haan | 381/111 |
| 2007/0189568 | A1 | 8/2007 | Wilk | |
| 2010/0067731 | A1 * | 3/2010 | De Haan | 381/386 |
| 2010/0329495 | A1 * | 12/2010 | Wendell et al. | 381/343 |

FOREIGN PATENT DOCUMENTS

| | | |
|---|---|---|
| WO | WO 9830065 | 7/1998 |
| WO | WO 2008099137 | 8/2008 |

* cited by examiner

*Primary Examiner* — Curtis Kuntz
*Assistant Examiner* — Joshua A Kaufman
(74) *Attorney, Agent, or Firm* — Marcus C. Dawes; Daniel L. Dawes

(57) ABSTRACT

A loudspeaker comprising a housing and a membrane mounted in said housing, which membrane can be set vibrating so as to produce sound, wherein the loudspeaker has at least one sound channel which extends between the membrane and the outer side of the housing, and wherein one or more local sound barriers are provided in the sound channel, which sound barriers locally block at least 15% of the cross-sectional area of the sound channel, such that amplification of the sound pressure occurs in the audible frequency range due to resonance.

11 Claims, 5 Drawing Sheets

LOUDSPEAKER

CROSS-REFERENCE TO RELATED APPLICATION

The present application is related to PCT Application, serial no. PCT/2011/050373, filed on May 27, 2011, and to Netherlands Application, serial no. 2004781, filed on May 31, 2010, both of which are incorporated herein by reference and to which priority is claimed.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The invention relates to a loudspeaker comprising a housing and a membrane mounted in said housing, which membrane can be set vibrating so as to produce sound, said loudspeaker having at least one sound channel which extends between the membrane and the outer side of the housing.

2. Description of Related Art

Such loudspeakers are generally known.

BRIEF SUMMARY OF THE INVENTION

The object of the invention is to provide a loudspeaker of the type described in the introduction, which has better mechanical and/or acoustic properties than the known loudspeakers.

According to the invention, one or more local sound barriers are to that end provided in the sound channel, which sound barriers locally block at least 15% of the cross-sectional area of the sound channel. The sound barriers amplify the sound level in certain frequency ranges to a significant degree, which in turns leads to insignificant losses in other frequency ranges or even in inaudible frequency ranges.

US 2004/0,047,488 describes a loudspeaker provided with an acoustically transparent grille in the sound channel, and consequently does not describe a sound barrier according to the invention.

Preferably, the sound barriers locally block between 25% and 75%, more preferably between 35% and 65%, even more preferably between 40% and 60%, of the cross-sectional area of the sound channel. The sound channel preferably has a width of 6-10 mm, more preferably of 7-9 mm, and preferably the sound barriers locally block on average at least 0.8 mm, more preferably 2-6 mm, even more preferably 2.8-5.2 mm, seen along the length of the gap, of the cross-sectional area of the sound channel. The sound barriers preferably have a thickness of 0.5-10 mm, more preferably 1-8 mm, even more preferably 2-6 mm.

In the sound channel, the sound barriers are preferably disposed at a location closer to the end of the sound channel, near the membrane, than to the other end of the sound channel, near the outer side of the housing, more preferably at a location at the end of the sound channel, near the membrane.

The sound channel is preferably gap-shaped, said one or more sound barriers being provided along substantially the entire length of the gap of the sound channel. The sound channel preferably has substantially parallel walls. In the preferred embodiment, the sound barriers are formed by one or more beams extending in the longitudinal direction of the gap. More preferably, the sound barriers are formed by one beam, which extends in the longitudinal direction of the gap, in the centre of the cross-section of the sound channel.

The sound barriers are preferably made of a non-magnetic material, more preferably of stainless steel, yellow brass, aluminium or copper, more preferably of copper. The additional effect that is achieved in this manner is that the sound barriers contribute toward an efficient dissipation of heat. This effect occurs in particular if the sound barrier is disposed close to the membrane.

The membrane is preferably a flexible membrane mounted in a frame. Preferably, the loudspeaker comprises a magnet unit which generates a magnetic field, and the membrane is provided with an electrical conductor arranged in a pattern on the membrane, which membrane is placed in the magnetic field in such a manner that a force is exerted on the membrane when current passes through the conductor pattern, which force can set the membrane in motion. Preferably, the conductor pattern is provided in at least two spaced-apart vibration areas on the membrane, whilst the loudspeaker has at least two sound channels which extend between the two vibration areas and the outer side of the housing.

BRIEF DESCRIPTION OF THE SEVERAL VIEWS OF THE DRAWINGS

The invention will now be explained in more detail with reference to an embodiment illustrated in the figures, in which.

DETAILED DESCRIPTION OF THE INVENTION

Figure 1:
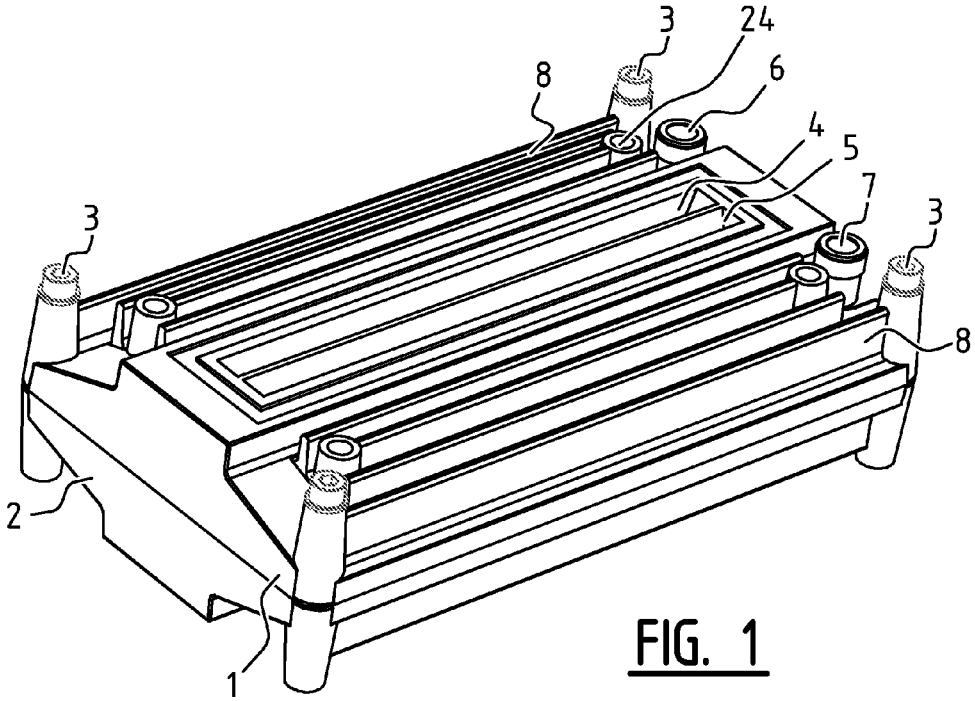
FIG. 1 is a partial perspective view of a loudspeaker.

According to FIG. 1, a loudspeaker comprises a housing which consists of two substantially identical metal parts 1, 2, which are mounted together by means of screws 3. Each housing part 1, 2 has two elongate slot-shaped recesses or sound channels 4, 5, which conduct the sound generated in the loudspeaker to the outside. Furthermore, a housing part 1 is provided with electrical connection points 6, 7, to which the sound signal wires of an amplifier can be connected. The housing 1, 2 is provided with outwardly, longitudinally extending cooling fins 8 for dissipating the heat generated in the loudspeaker.

Figure 2:
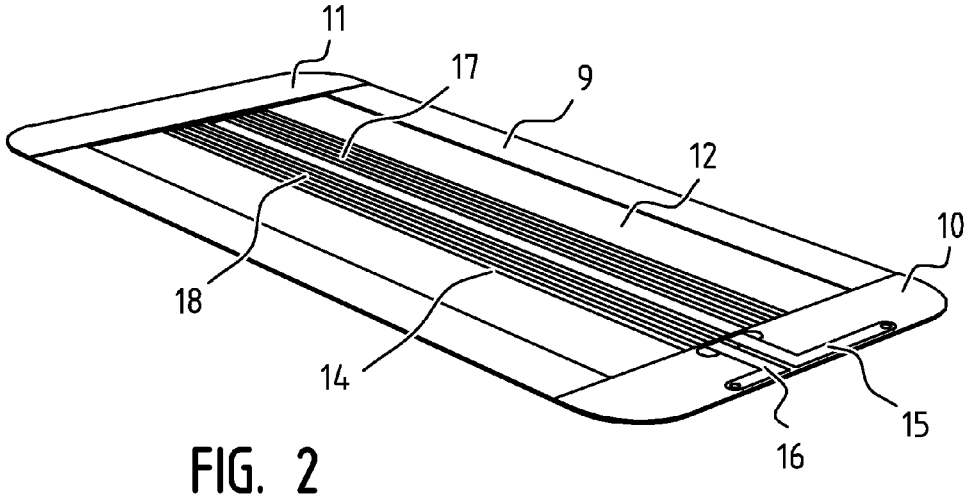
FIG. 2 is a perspective view of a membrane unit.

The housing part 1, 2 enclose a frame shown in FIG. 2, which consists of a first frame-shaped frame member 9 and two strip-shaped frame members 10, 11. The frame members 9, 10, 11 are preferably made of copper or anodized aluminium. The exterior surface of the frame members 9, 10, 11 makes contact with the housing 1, 2 all over. A flat vibration membrane 12 is affixed to the frame member 9 by means of a glue or by means of a thin, double-sided adhesive tape. The glue or the tape is of a heat-conducting type. Provided on the membrane 12 is an electrical conductor pattern 14, which is connected to the connection points 6, 7, and which sets the membrane vibrating when the amplifier sends an electrical signal to the loudspeaker.

Figure 3:
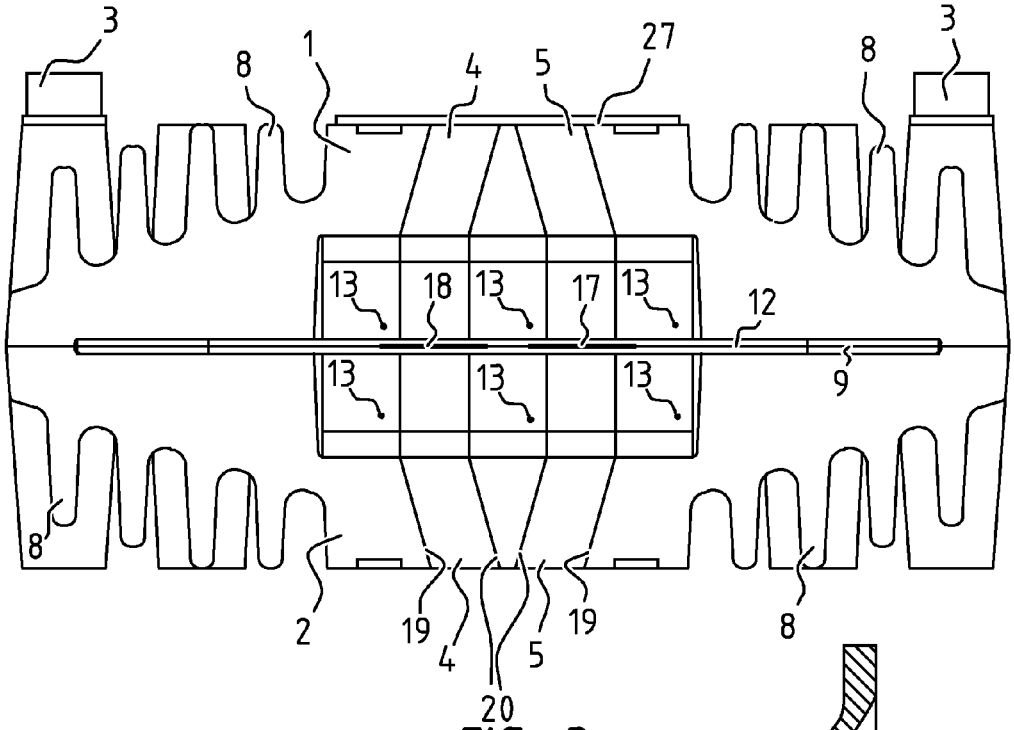
FIG. 3 is a cross-sectional view of the loudspeaker of FIG. 1.

To that end the loudspeaker comprises magnets 13, as shown in FIG. 3, which generate a permanent magnetic field in which the conductor pattern 14 of the membrane 12 is located. The conductor pattern 14 is formed by an electrically conductive path which is provided in an elongate, rectangular spiral on one side of the membrane 12. On the short sides of the rectangular pattern, the frame members 10, 11 are provided directly on the conductor pattern. The glue or the adhesive tape by means of which the frame members are affixed to the conductive wire must be electrically insulating, therefore. On the other side of the membrane 12, said short sides of the pattern are likewise covered, by the short sides of the frame-shaped frame member 9. The conductor pattern 14 can thus transfer heat to the frame members 9, 10, 11 on both sides in this case.

The two ends of the conductive wire are connected to conductor terminals 15, 16 on the frame member 10, which are in turn electrically connected to the connection points 6, 7. The conductor terminals 15, 16 are electrically insulated from frame member 10. The lines of the conductor pattern 14, which extend parallel to each other in the longitudinal direction between the frame members 10, 11, form two spaced-apart vibration areas 17, 18.

Figure 5:
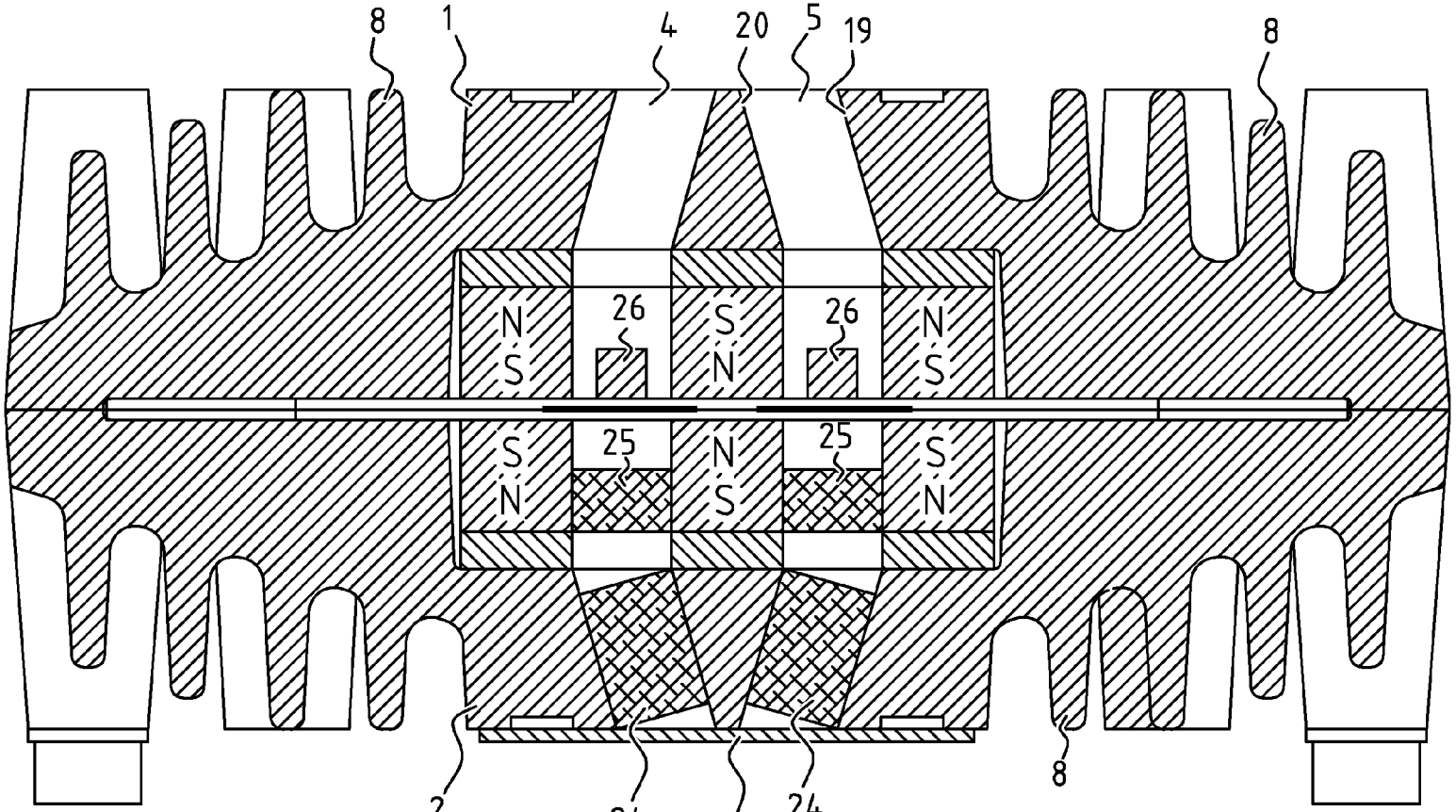
FIG. 5 is a cross-sectional view of a loudspeaker according to the invention.

With reference to FIG. 3, the sound channels 4, 5 extend from the two spaced-apart vibration areas 17, 18 on the surface of the membrane 12 to the outer side of the housing parts 1, 2, which sound channels 4, 5 are closed on one side by a closing plate 27, however, because the loudspeaker must emit the sound to one side only. The channels on the rear sides are filled with dampers 24, 25 of a synthetic foam, as shown in FIG. 5, so as to absorb the sound emitted to the rear. Seen in a direction away from the membrane, the sound channels 4, 5 first extend perpendicularly to the membrane, viz. in the area between the magnets 13, and subsequently the sound channels 4, 5 incline towards each other. Both the outer walls 19 and the inner walls 20 of each sound channel 4, 5 incline towards each other, with the parallel relationship between the inner wall 19 and the outer wall 20 of a sound channel 4, 5 remaining unchanged. On the outer side of the loudspeaker, only a very small spacing remains between the inner walls 19 of the two sound channels 4, 5, said spacing being at least several times smaller than the spacing between the vibration areas 17, 18. In this way the fronts of the sound waves generated by the two vibration areas 17, 18 are led towards each other and joined together, thereby preventing disadvantageous interference between the two wave fronts.

Figure 4:
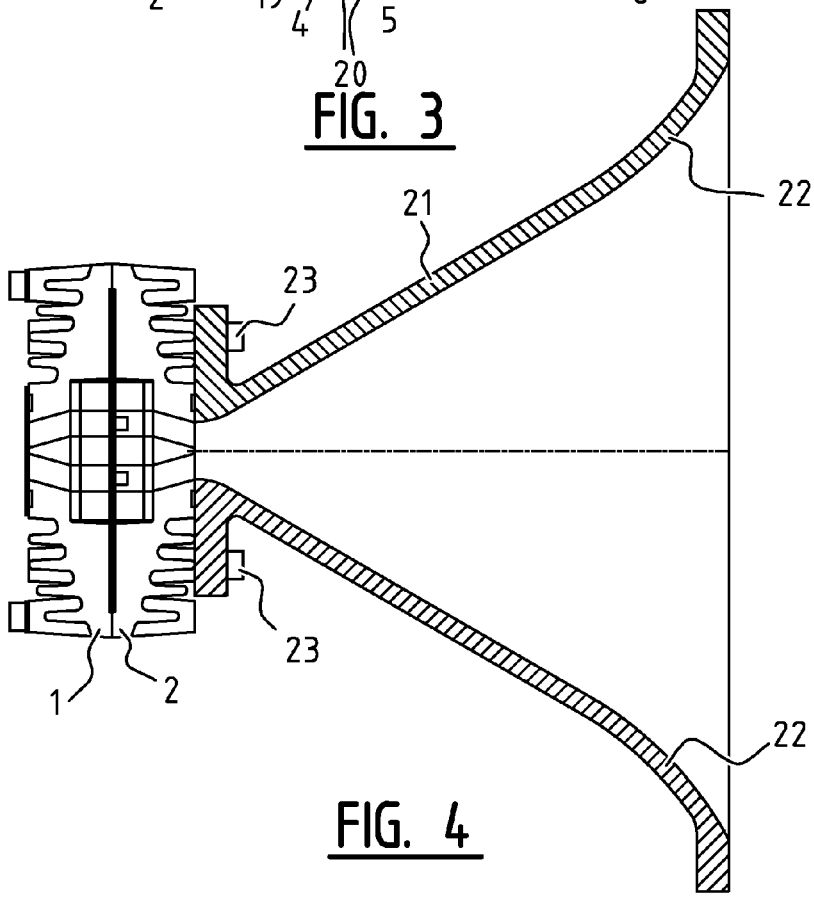
FIG. 4 is a cross-sectional view of the loudspeaker of FIG. 1, on which a sound horn is mounted.

FIG. 4 shows a sound horn 21 which is mounted in threaded holes 24 of the loudspeaker by means of screws 23. The outer walls 19 of the sound channels 4, 5 join the walls 22 of the sound horn 21. The sound horn 21 provides a gradual extension of the sound front that exits the sound channels 4, 5 before it extends further into the environment. The horn, which is made of a metal, also contributes toward the heat dissipation of the loudspeaker.

FIG. 5 shows a loudspeaker according to the invention, which is identical to the loudspeaker described above, with the following adaptation. A copper beam 26 is placed between the membrane 12 and the outer side of the housing 2 in each of the channels 4, 5. The beam 26 forms the sound barrier for the sound generated by the membrane 12. The beam 26 extends along the entire length of the channels 4, 5. Seen in transverse direction, the beam 26 extends in the centre of the channels 4, 5, so that an identical gap-shaped opening is present on either side of the beam 26, through which the sound from the membrane can reach the channels 4, 5. The width of the channels 4, 5 is 8 mm, the width (w) of the beam 26 is 4 mm, so that 50% of the cross-sectional area of the channels is blocked by the beam. The thickness (t) of the beam 26 is 4 mm.

Different shapes of sound barriers in the sound channels 4, 5 are also possible, in which connection perforated plates or several beams provided in the longitudinal direction or in the transverse direction may be considered. It has been found that the embodiment shown here is the most effective embodiment.

Figure 8:
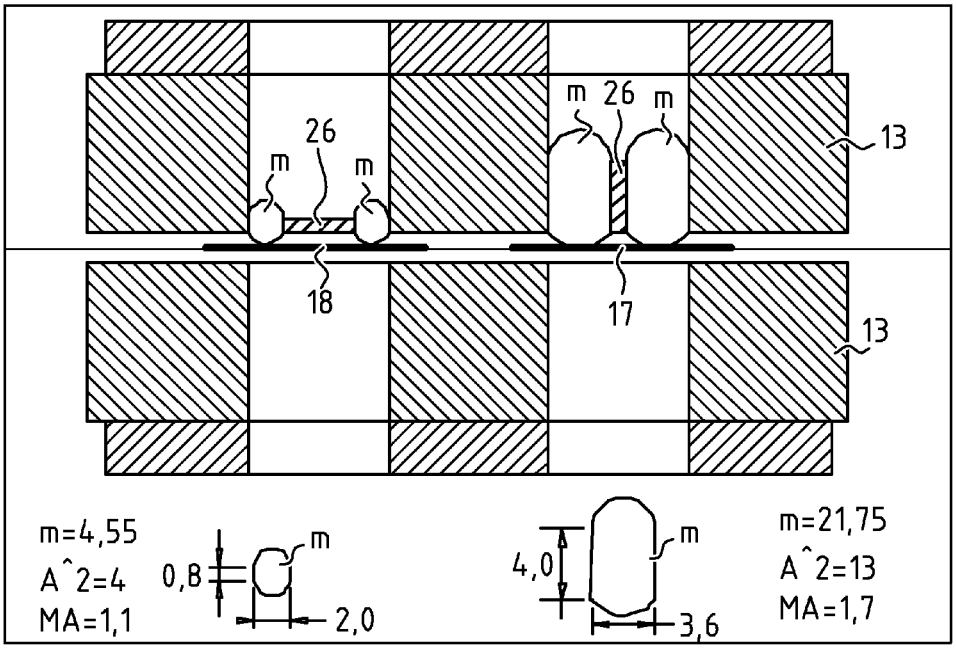
FIGS. 8 and 9 illustrates the determination of the acoustic mass (MA) for various embodiments of the invention.
Figure 9:
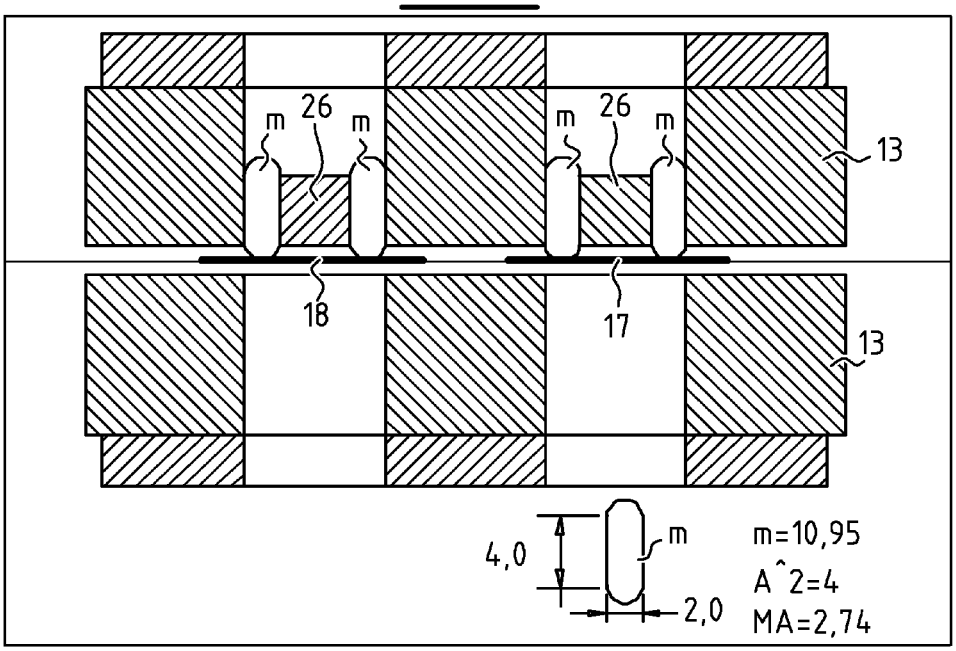

By providing the sound barriers in front of the membrane 12, amplification of the sound pressure will take place due to resonance. Said resonance occurs as a result of the resonation of the acoustic mass (MA) with the acoustic compliance (CA) of the air in front of the conductor pattern on the membrane. The acoustic mass is defined by: air mass/(area 2), or MA=m/(A 2). The end correction of semi-cylindrical air masses extending on the front side and the rear side of the sound barriers (see FIGS. 8 and 9) must be taken into account upon determination of the air mass (m).

The resonance frequency (fb) is defined by: fb=1/(2*pi*square_root($M_A$*$C_A$) or fb=$1/2\pi\sqrt{M_A C_A}$.

Using the above formula, it is possible to predict the effect of various aspects of barriers such as the beam 26, so as to effect amplification of the sound in the audible range, and said predictions are confirmed by the following test results of a number of embodiments.

Figure 6:
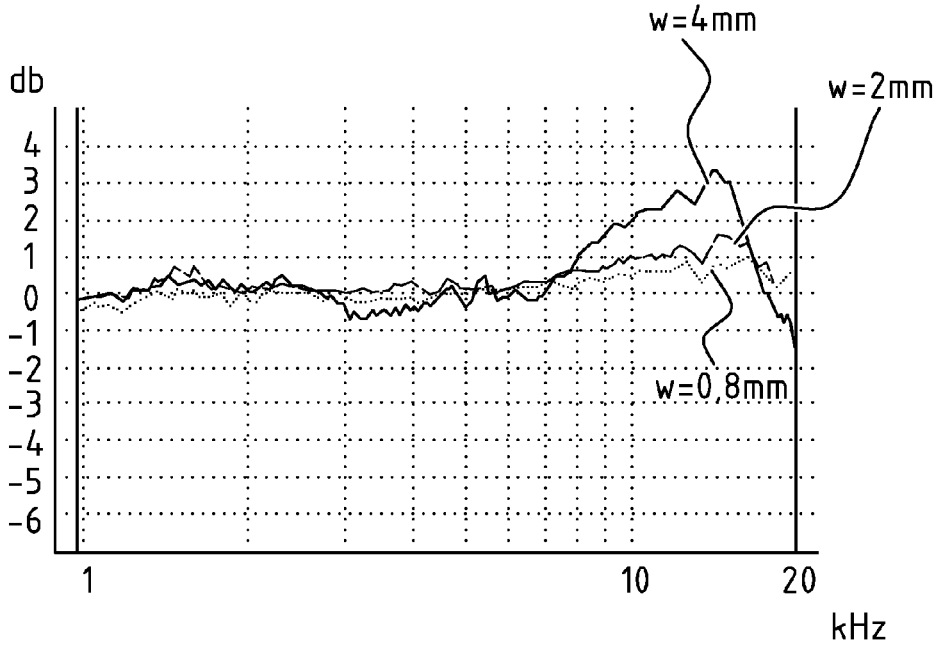
FIG. 6 is a graph showing the influence of the width (w) of sound barriers according to the invention on the sound intensity for different frequencies.

Width: FIG. 6 shows that if the blocking of the channel amounts to 10% (0.8 mm) (with a thickness (t) of 4 mm), an amplification of about 0.8 dB will take place in the range around 15 kHz. A maximum amplification takes place if the blocking amounts to about 50% (4 mm), in which case the amplification is more than 3 dB. The resonance decreases if the blocking amounts to more than 50%.

Figure 7:
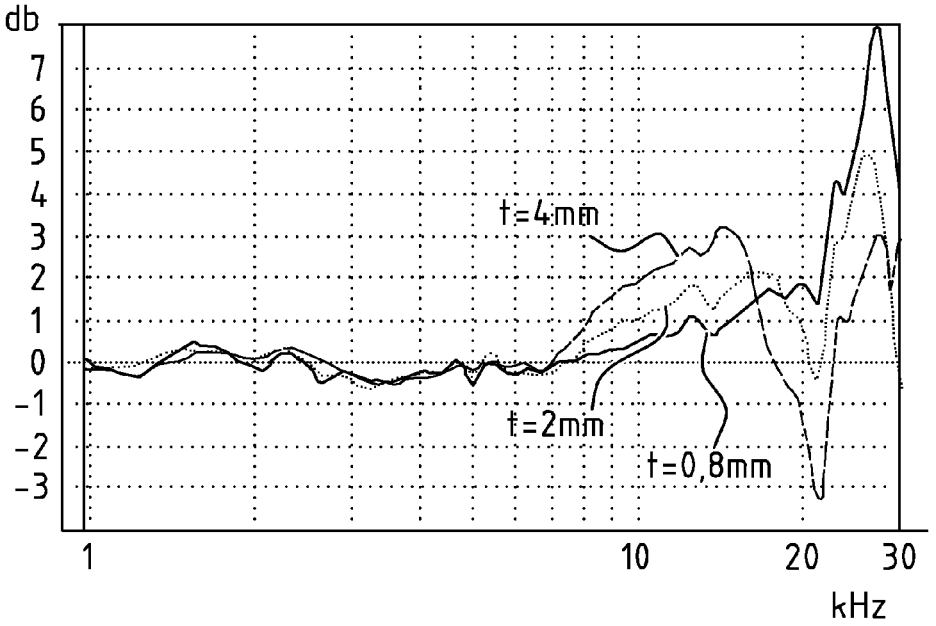
FIG. 7 is a graph showing the influence of the thickness (t) of sound barriers according to the invention on the sound intensity for different frequencies.

Thickness: FIG. 7 shows that if the blocking in the channel is relatively thin (0.8 mm in this example) (with a width (w) of 4 mm), this will result in an amplification of about 1 dB in the range around 15 kHz, with a maximum amplification taking place in the (inaudible) range above 20 kHz. In the case of a thickness of 4 mm, the amplification is more than 3 dB. Generally it can be said that the thicker the blocking, the lower the peak frequency with the maximum amplification. Increasing the thickness leads to attenuation of frequencies, with a high air speed (about 3 kHz in this example).

Location: tests have shown that the greatest effect is achieved if the blocking is disposed as close to the membrane as possible.

Shape: tests have shown that the amplification effect diminishes as the number of openings increases (for example in the case of a grille). Because of this, a beam in the centre of the width of the channel (two openings) is used in this embodiment.

SEQUENCE LISTING

Not applicable.

The invention claimed is:

1. A loudspeaker comprising:

a housing;

a membrane mounted in said housing, which membrane can be set vibrating so as to produce sound;

at least one sound channel which is defined between the membrane and the outer side of the housing; and one or more local sound barriers provided in the sound channel defined in the housing, which sound barriers locally block at least 15% of the cross-sectional area of the sound channel, such that amplification of the sound pressure occurs in the audible frequency range due to resonance within the housing, wherein the sound barriers are disposed at a location in the sound channel closer to the end of the sound channel, near the membrane, than to the other end of the channel, near the outer side of the housing.

2. A loudspeaker according to claim 1, wherein the sound barriers locally block between 25% and 75% of the cross-sectional area of the sound channel.

3. A loudspeaker according to claim 1, wherein the sound channel has a width of 6-10 mm, and the sound barriers locally block on average at least 0.8 mm of the cross-sectional area of the sound channel.

4. A loudspeaker according to claim 1, wherein the sound barriers have a thickness of 0.5-10 mm.

5. A loudspeaker according to claim 1, wherein the sound channel is gap-shaped, said one or more sound barriers being provided along substantially the entire length of the gap of the sound channel.

6. A loudspeaker according to claim 5, wherein the sound barriers are formed by one or more beams extending in the longitudinal direction of the gap.

7. A loudspeaker according to claim 5, wherein the sound barriers are formed by a beam which extends in the longitudinal direction of the gap, in the centre of the cross-section of the sound channel.

8. A loudspeaker according to claim 1, wherein the sound barriers are made of a non-magnetic material, stainless steel, yellow brass, aluminium or copper.

9. A loudspeaker according to claim 1, wherein the walls of the channels extend substantially parallel to each other.

10. A loudspeaker according to claim 1, wherein the membrane is a flexible membrane mounted in a frame.

11. A loudspeaker according to claim 10, wherein a conductor pattern is provided in at least two spaced-apart vibration areas on the membrane, wherein the loudspeaker has at least two sound channels which extend between the two vibration areas and the outer side of the housing.

* * * * *